US010145657B2

(12) United States Patent
Martinez et al.

(10) Patent No.: US 10,145,657 B2
(45) Date of Patent: Dec. 4, 2018

(54) SHIELD COVER AND SHIELD INCORPORATING THE SAME

(71) Applicant: Mission Ready Services, Inc., Kelowna (CA)

(72) Inventors: Francisco Martinez, Wellesley, MA (US); Bettina Pasquantonio, Wrentham, MA (US); Yolita Nugent, Boston, MA (US); Adam Whiton, Boston, MA (US)

(73) Assignee: Mission Ready Services, Inc., Kelowna (CA)

( * ) Notice: Subject to any disclaimer, the term of this patent is extended or adjusted under 35 U.S.C. 154(b) by 30 days.

(21) Appl. No.: 15/087,586

(22) Filed: Mar. 31, 2016

(65) Prior Publication Data

US 2016/0290770 A1 Oct. 6, 2016

Related U.S. Application Data

(60) Provisional application No. 62/141,983, filed on Apr. 2, 2015.

(51) Int. Cl.
*F41H 5/08* (2006.01)
*F41H 13/00* (2006.01)

(52) U.S. Cl.
CPC ..... *F41H 5/08* (2013.01); *F41H 13/0018* (2013.01)

(58) Field of Classification Search
CPC ..... F41H 13/0018
USPC ..... 361/232; 43/98
See application file for complete search history.

(56) References Cited

U.S. PATENT DOCUMENTS 4,485,426 A * 11/1984 Kerls ..... A41D 1/00 361/232
4,713,725 A * 12/1987 Kroll ..... B60R 21/12 361/232
5,107,620 A * 4/1992 Mahan ..... A01M 1/223 43/112
5,158,039 A * 10/1992 Clark ..... A01K 15/02 119/712
5,986,243 A * 11/1999 Campf ..... A41D 13/0051 219/211

(Continued)

FOREIGN PATENT DOCUMENTS

WO WO-2006071370 A1 * 7/2006 ..... F41H 5/08

*Primary Examiner* — Reginald S Tillman, Jr.
(74) *Attorney, Agent, or Firm* — Thomas P. O'Connell; O'Connell Law Firm

(57) ABSTRACT

A shield cover and a shield retaining such a cover with an electrical discharge system with an activated condition wherein electrical power is applied to an electrically conductive pathway, which can be formed from positive and negative electrical pathways running generally parallel, on the shield cover. The shield cover has a shield cover body for being applied to, retained by, and removed from the shield body. An electrical discharge system is formed by a source of electrical power, the electrically conductive pathway, and a switch or other actuator for activating the electrical discharge system to the activated condition. The shield cover body could be formed from a stretch fabric, and the electrically conductive pathway could be formed by conductive thread. Electrical insulation material can prevent arcing between the shield cover and the shield body. An arcing structure can automatically or selectively produce visible or audible electrical arcing.

13 Claims, 5 Drawing Sheets

(56) References Cited

U.S. PATENT DOCUMENTS

| | | | | |
|---|---|---|---|---|
| 6,210,771 | B1 * | 4/2001 | Post | D03D 15/00 139/1 R |
| 6,925,748 | B2 * | 8/2005 | McGill | A01M 29/26 43/98 |
| 6,961,227 | B1 * | 11/2005 | Whiton | A41D 13/008 361/232 |
| 6,993,867 | B2 * | 2/2006 | Toyota | A01M 19/00 361/232 |
| 8,154,844 | B2 * | 4/2012 | Brown | F41H 5/08 102/502 |
| 8,991,085 | B1 * | 3/2015 | Knapp | F41H 13/0018 361/232 |
| 2003/0137795 | A1 * | 7/2003 | Buening | F41H 13/0018 361/253 |
| 2004/0264099 | A1 * | 12/2004 | Sikes | F41H 13/0018 361/232 |
| 2006/0175114 | A1 * | 8/2006 | Dysart | A47C 31/00 180/271 |
| 2010/0200558 | A1 * | 8/2010 | Liu | H05B 3/342 219/212 |
| 2014/0224109 | A1 * | 8/2014 | Chandler | F41H 5/08 89/36.07 |
| 2017/0074622 | A1 * | 3/2017 | Wallace | F41H 13/0018 |

* cited by examiner

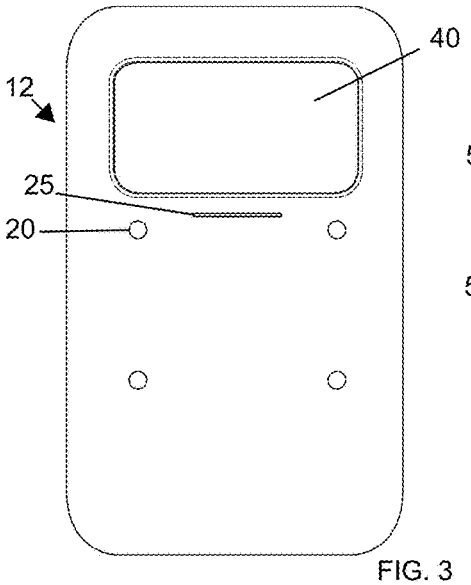
FIG. 3
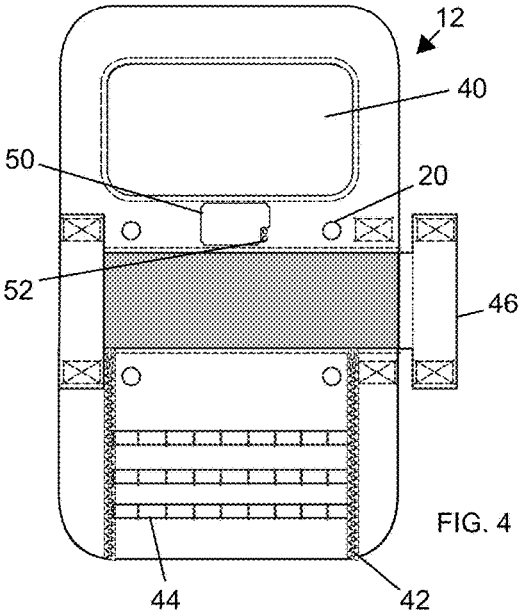
FIG. 4
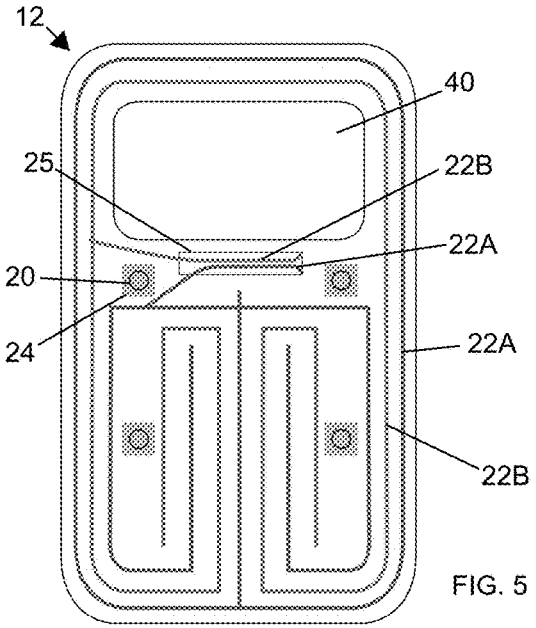
FIG. 5
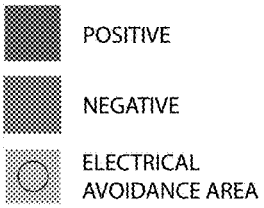

SHIELD COVER AND SHIELD INCORPORATING THE SAME

FIELD OF THE INVENTION

The present invention relates generally to shields for the human body. More particularly, disclosed herein is a removable, flexible, textile-based shield cover and a shield incorporating such a cover capable of delivering an electrical discharge to a plurality of conductive pathways incorporated into the removable cover. The shield cover can be textile-based with electrically conductive pathways, electronic components with an electrical supply for generating the electrical output, and an actuator, such as a switch, to activate the system when desired.

BACKGROUND OF THE INVENTION

Military and law enforcement officers often use shields, such as ballistic shields and riot or crowd control shields, to stop or deflect bullets fired at the carrier and in breaching operations and crowd control. When the shields are used in close-quarters, including during breaching operations or crowd control, aggressors will often push up against the shields or grab at the shields in an effort to move the shield or pull it away from the carrier thereby making the carrier vulnerable. Consequently, adding an electrical discharge system and method to the shield would be beneficial in breaking contact with such aggressors and discouraging this type of behavior.

Shields having electrical discharge abilities built into the shield itself have been disclosed. There are also conversion kits available to transform existing shields by adding electrical discharge capabilities. However, it has become clear to the present inventors that there remains a need in the field for a system and method that permits effective and controllable electrical discharge capabilities to be readily applied to and removed from such shields.

SUMMARY OF THE INVENTION

With an awareness of the foregoing, the present inventors set forth with the fundamental object of providing a cover for shields and shields incorporating such covers that are capable of producing effective, controllable, and repeatable electrical discharge.

A related object of the invention is to provide a cover for shields that can be readily applied to and removed from such shields.

These and further objects and advantages of the present invention will become obvious not only to one who reviews the present specification and drawings but also to those who have an opportunity to experience an embodiment of the shield cover disclosed herein in use. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, one embodiment of the invention comprises a shield cover for being removably retained relative to a shield with a shield body. The shield cover can have a shield cover body for being applied to, retained by, and removed from the shield body. An electrical discharge system can comprise a source of electrical power, at least one electrically conductive pathway retained by the shield cover body, and an actuator for activating the electrical discharge system to an activated condition wherein electrical power is applied to the electrically conductive pathway.

The at least one electrically conductive pathway could, for instance, be formed by conductive thread. For instance, the at least one electrically conductive pathway could be formed with first and second strands of electrically conductive thread running in a generally parallel configuration with the first strand comprising a positive conductive thread and the second strand comprising a negative conductive thread. It would also be within the scope of the invention to have the at least one electrically conductive pathway formed with a unitary member of material incorporating both positively and negatively conductive wires, strands, or other members. Under certain practices of the invention, electrical insulation material could be retained by the shield cover body for preventing arcing relative to the shield body.

Embodiments of the shield cover are contemplated wherein the shield cover body has at least a resilient portion. By way of example, the shield cover body can be at least partially formed from a stretch fabric.

Moreover, as taught herein, the actuator for activating the electrical discharge system to an activated condition could take the form of a switch for selectively activating the electrical discharge system. The switch could, in certain embodiments comprise a momentary switch. The switch could be retained relative to the shield cover body by a flexible cord.

In certain embodiments, an arcing structure can be retained by the shield cover body. The arcing structure could be capable of producing at least one visible electrical arc when actuated. Additionally or alternatively, the arcing structure could be capable of producing at least one audible electrical arc when actuated.

Also disclosed and protected is a shield removably retaining a shield cover as taught herein. The shield can have a shield body of any type, and the shield cover body can be selectively applied to, retained by, and removed from the shield body. Again, an electrical discharge system can be provided. The electrical discharge system can comprises a source of electrical power, at least one electrically conductive pathway retained by the shield cover body, and an actuator for activating the electrical discharge system to an activated condition wherein electrical power is applied to the electrically conductive pathway. The shield cover can have any or all of the further characteristics disclosed and protected herein.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

In the accompanying drawing figures:

FIG. 3 is a view in front elevation of an alternative shield cover according to the invention;

FIG. 4 is a view in rear elevation of the shield cover of FIG. 3;

FIG. 5 is a schematic view of the shield cover of FIG. 3 illustrating the electrically conductive pathways;

Figure 1:
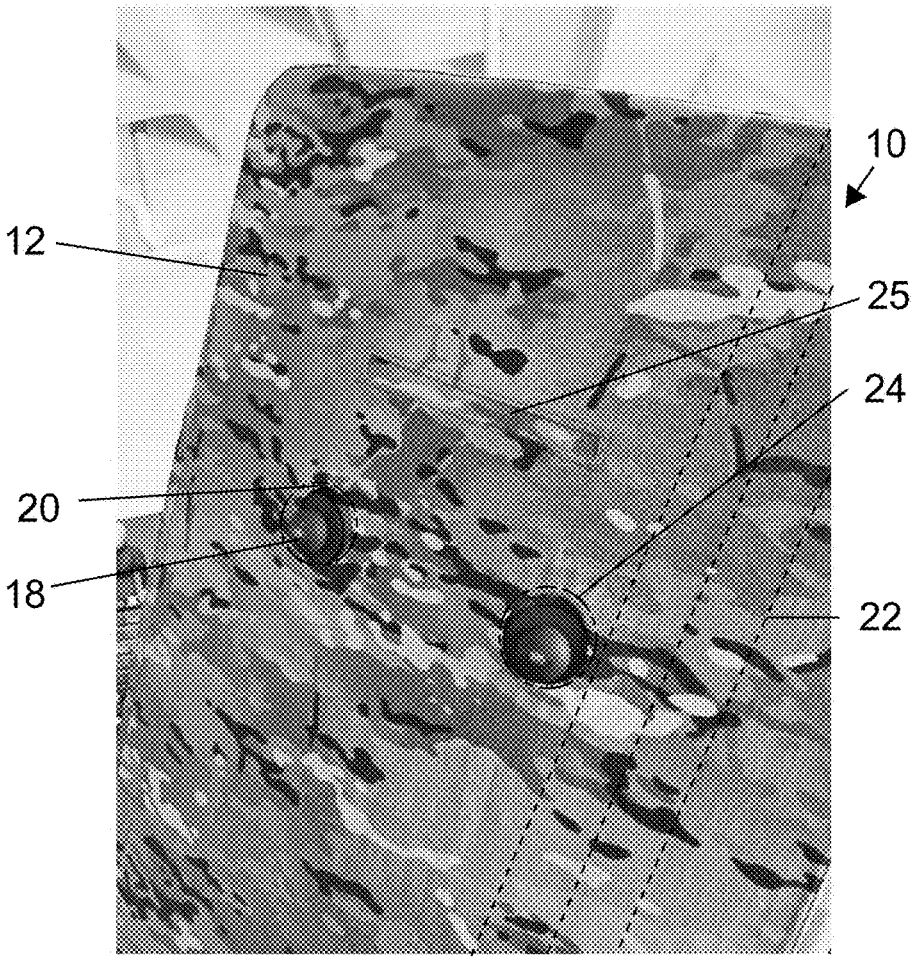
FIG. 1 is an anterior perspective view of a shield cover and a shield incorporating the shield cover according to the invention.

Any specific features included in the drawing figures should be considered merely to expound on and elucidate the present disclosure and should not be considered as limiting as to material, dimension, relative positioning, or in any other way.

DETAILED DESCRIPTION OF PREFERRED EMBODIMENTS

As is the case with many inventions, the present invention for a shield cover and a shield incorporating the shield cover is subject to a wide variety of embodiments. However, to ensure that one skilled in the art will fully understand and, in appropriate cases, be able to practice the present invention, certain preferred embodiments of the broader invention revealed herein are described below and shown in the accompanying drawings.

Figure 2:
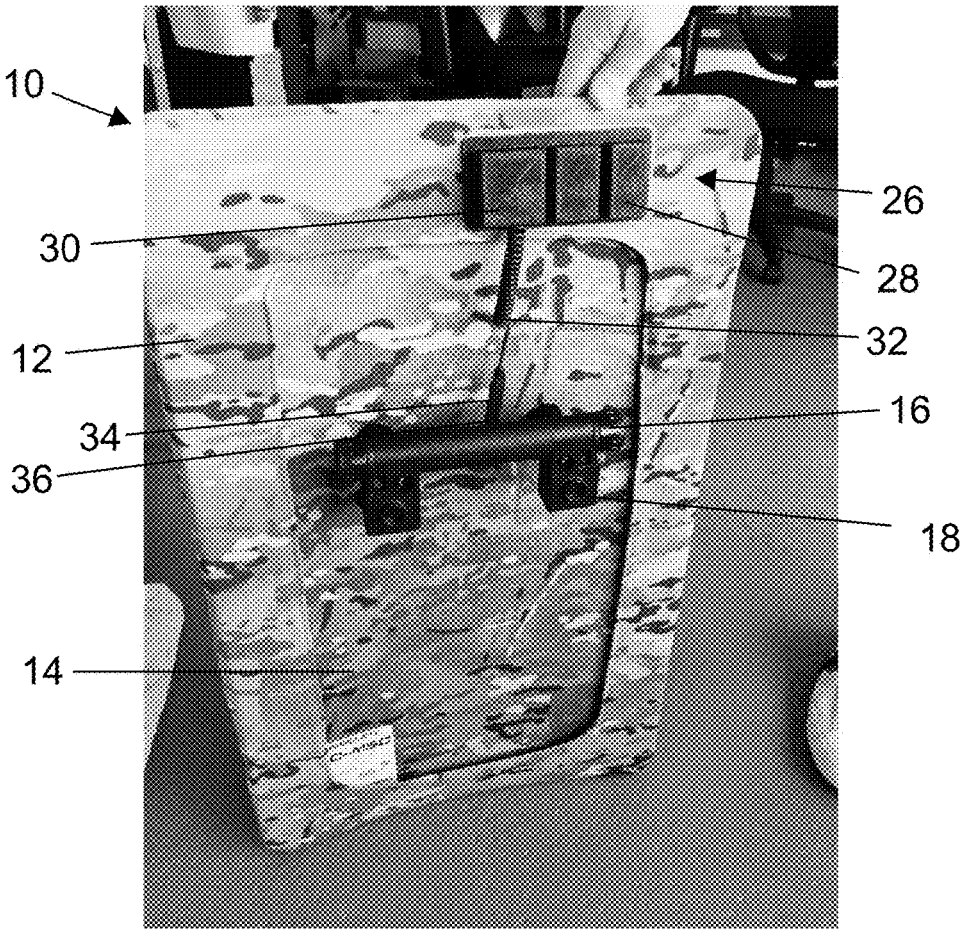
FIG. 2 is a posterior perspective view of the shield cover and shield incorporating the same of FIG. 1.

A shield according to the invention is indicated generally at 10 in FIGS. 1 and 2. There, a shield cover 12 as disclosed herein is retained relative to a shield body 14. The disclosed shield cover 12 is easily donned and doffed relative to a shield body 14, such as a ballistic shield body or a riot or crowd control shield body, as shown, for instance, in FIG. 2. A shield body 14 can selectively be provided with electrical discharge capability by use of the shield cover 12, which can be a textile cover that can be easily slipped on and slipped off.

The present invention thus pertains to a removable, flexible, textile-based shield cover 12 capable of delivering an electrical discharge over one or a plurality of conductive pathways incorporated into the removable shield cover 12. The shield cover 12 can, in certain embodiments, be made partially or entirely from a stretch fabric that is constructed to stretch easily and fit tight to the shield body 14 and, potentially, to shield bodies 14 of varied shapes and sizes. The shield cover 12 can additionally or alternatively incorporate elastic banding about an edge thereof thereby permitting the shield cover 12 to be disposed over and retained on a shield body 14.

Electrically conductive pathways capable of carrying the electrical discharge are incorporated into, onto, or under the fabric cover 12. The fabric cover 12 can have multiple layers. The electrically conductive pathways could, by way of example and not limitation, be formed with sewn or woven conductive threads, schematically indicated at 22, electrically conductive screen printed inks, or any other suitable method or mechanism for establishing an electrically conductive pathway that may now exist or hereafter be developed. Embodiments are contemplated wherein the electrically conductive pathway or pathways 22 are arranged on a separate electrical layer beneath the outer surface of the cover 12 with a thin cotton material disposed thereon, such as by stitching or any other method.

As seen in FIG. 1, the shield cover 12 can incorporate a gap 25, which can be referred to as a spark gap 25. Electrically conductive thread 22 can be retained by the shield cover 12 surrounding all or part of the spark gap 25. When the electrically conductive thread 22 is provided with an electrical charge, an electrical charge can be applied to a being, such as a human being, who touches the outer face of the shield 10, such as to bridge the spark gap 25 or otherwise to be exposed to the electrical charge being provided to the electrically conductive thread 22 or other electrically conductive pathway.

In most shield designs, there are metallic components, such as handles 16 and handle hardware 18, which would be electrically conductive and could interfere with the effectiveness and safety of the electrical discharge. For this reason, the disclosed shield cover 12 provides an electrical insulation material that is incorporated into the shield cover 12 to ensure that the cover 12 will perform and not electrically short to any metallic components incorporated into the shield body 14 itself. This electrical insulation could be applied to the entire shield cover 12 or to particular locations where metallic components are located. For example, FIG. 1 shows metallic mounting hardware 18 for a handle grip 16, seen in FIG. 2, protruding through the outer side of the body 14 of the shield 10. In this instance, openings 20 in the shield cover 12 were made corresponding in location to the protruding hardware 18. The areas at the edges of the openings 20 incorporate electrical insulation 24 and adequate clearance distances to avoid electrical arcing.

The shield cover 12 includes an electrical discharge system 26 for controlling and operating the electrical discharge exacted through the electrically conductive pathways 22. In certain embodiments, the electrical discharge system 26 could include one or more batteries 28 or any other power source, associated electronic circuitry 30 to control the electrical output, and one or more activation mechanisms to enable and, additionally or alternatively to activate the electrical discharge.

Enablement or activation of the electrical discharge could be carried forth in a number of ways within the scope of the invention. By way of example, the electrical discharge could be enabled or activated by a momentary switch 34 with electricity being discharged only when the switch 34 is depressed or otherwise triggered or for a timed output, such as by activating for a predetermined amount of time or a predetermined number of activations in response to sensed external contacts.

Where a switch 34 is employed, it could be located in any convenient location for the operator. In contemplated example of the shield cover 12, the switch 34 can for example, be tethered and in electrical communication with the remainder of the electronic system via a cord 32, such as a coiled cord 32. With that, the switch 34 could be selectively placed, such as by hook and/or loop material 36 or some other attachment mechanism, to substantially any desired location on the shield. Moreover, under such a construction, the switch 34 could be held directly in the operator's hand.

It is further contemplated that some or all of the electrical discharge system 26 can be removable from the shield cover 12. This can be facilitated, for example, by easily separated mechanical and electrical connections between the body of the shield cover 12 and some or all of the electrical discharge system 26.

The flexible shield cover 12 could incorporate an arcing structure 25 for producing visible and, additionally or alternatively, audible electrical arcing within the fabric structure of the shield cover 12. The arcing structure 25 can, for example, be achieved through a seaming construction. Relevant, but non-limiting, teaching may be found, for instance, in U.S. Pat. No. 6,961,227 for an Electrically Charged Self-Defense Wearable, which is incorporated herein by reference. When actuated, whether selectively or automatically, this arcing structure 35 can act as a visible and audible warning or deterrent and, to an extent, as a safety mechanism to prevent, for example, unintended contact with the electrical discharge. Other methods are within the scope of the invention except as it might expressly be limited by the claims. The visible and audible warnings could be supplemented or emphasized with additional lighting elements and audible tones. Any additional lighting and auditory elements and necessary wiring incorporated into the shield cover 12 can advantageously remain flexible and conformal with the fabric of the cover 12.

It will be understood that inventive aspects of the shield 10 and shield cover 12 disclosed herein could be carried forth in widely varied embodiments. One such alternative is depicted in FIGS. 3 through 7. The shield cover 12 is depicted alone in FIGS. 3 through 5 and retained relative to a shield body 14 in FIGS. 6 and 7. The shield cover 12 is again removable and replaceable relative to the shield body 14. The shield cover 12 could, for instance, be a textile cover that can be easily slipped on and slipped off the shield body 14. The shield body 14 could be a ballistic shield body, a riot or crowd control shield body, or any other type of shield body. By application of the shield cover 12, the shield body 14 can selectively be provided with electrical discharge capability.

As is illustrated schematically in FIG. 5, positive and negative electrically conductive pathways 22A and 22B capable of carrying the electrical discharge are incorporated into the shield cover 12. Together, the positive and negative electrically conductive pathways 22A and 22B can be considered to cooperate to form at least one electrically conductive pathway. Here, the positive and negative electrically conductive pathways 22A and 22B run separately, but it would be within the scope of the invention to have the at least one electrically conductive pathway formed with a unitary member of material incorporating both positively and negatively conductive wires, strands, or other members. Again, the electrically conductive pathways 22A and 22B could, in some non-limiting examples, be formed with sewn or woven conductive threads, electrically conductive screen printed inks, or any other suitable method or mechanism for establishing an electrically conductive pathway that may now exist or hereafter be developed. The pathways 22A and 22B in the depicted embodiment traverse the peripheral and central portions of the shield cover 12.

The shield cover 12 can again incorporate a spark gap 25. The spark gap 25 can traverse laterally across a portion of the exterior face of the shield cover 12. The positive and negative electrically conductive pathways 22A and 22B in this example communicate longitudinally in spaced, generally parallel relation to one another along the spark gap 25. With that, the pathways 22A and 22B span and surround the length of the spark gap 25.

When the electrically conductive pathways 22A and 22B are provided with an electrical charge, an electrical charge can be applied to a being, such as a human being, who touches the outer face of the shield 10, such as to bridge the positive and negative electrically conductive pathways 22A and 22B on the face of the shield cover 12 or over the spark gap 25.

With the positive and negative electrically conductive pathways 22A and 22B exposed along the spark gap 25, the spark gap 25 can establish an arcing structure 38 for producing visible and, additionally or alternatively, audible electrical arcing within the fabric structure of the shield cover 12. When actuated, whether selectively or automatically, this arcing structure of the spark gap 25 can act as a visible and audible warning or deterrent and, to an extent, as a safety mechanism to prevent, for example, unintended contact with the electrical discharge. Again, other methods are within the scope of the invention except as it might expressly be limited by the claims. The visible and audible warnings could be supplemented or emphasized with additional lighting elements and audible tones. Any additional lighting and auditory elements and necessary wiring incorporated into the shield cover 12 can advantageously remain flexible and conformal with the fabric of the cover 12.

Figure 6:
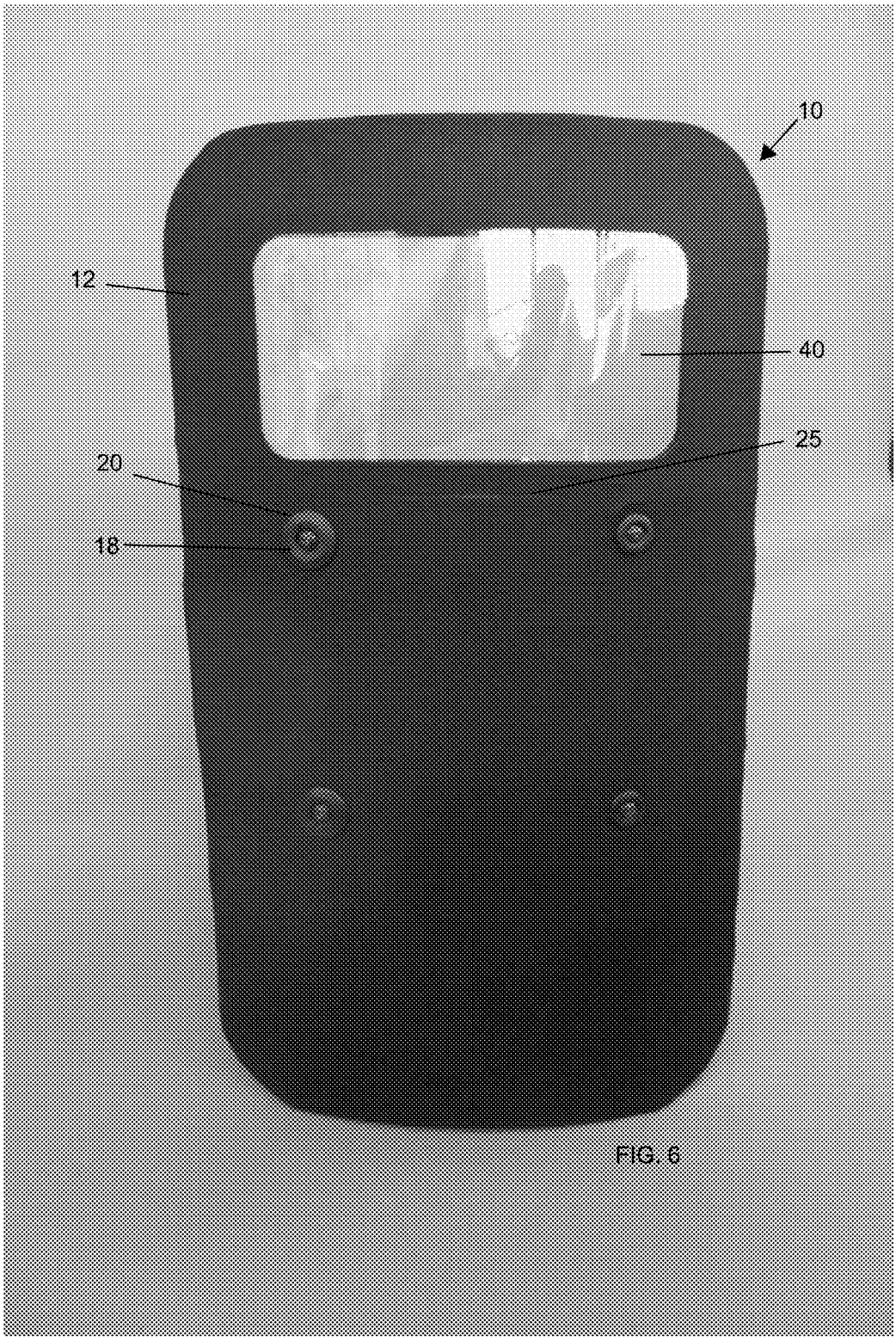
FIG. 6 is a view in front elevation of a shield retaining the shield cover of FIG. 3.
Figure 7:
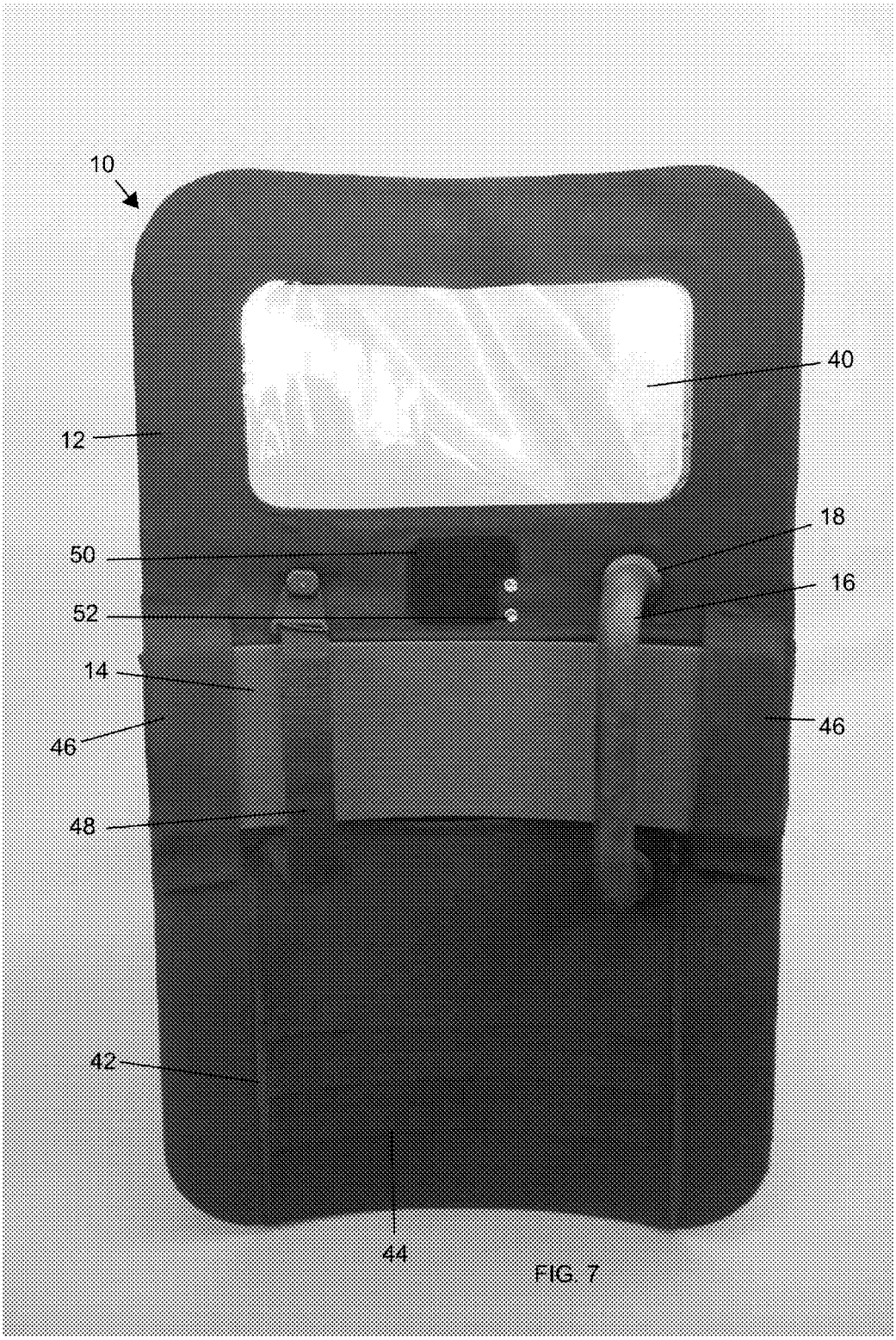
FIG. 7 is a view in rear elevation of the shield retaining the shield cover of FIG. 3.

The shield cover 12 again incorporates electrical insulation material and structural properties to ensure that the cover 12 will perform and will not electrically short to any metallic components incorporated into the shield body 14 itself. This electrical insulation could be applied to the entire shield cover 12 or to particular locations where metallic components are located. For example, FIGS. 6 and 7 show metallic mounting hardware 18 for a handle grip 16. Openings 20 are provided in the shield cover 12 corresponding in location to the protruding hardware 18. The areas at the edges of the openings 20 incorporate electrical insulation 24 and adequate clearance distances to avoid electrical arcing.

The shield cover 12 can selectively retain an electrical discharge system as shown previously for controlling and operating the electrical discharge exacted through the electrically conductive pathways 22A and 22B. As shown in FIG. 2, for instance, the electrical discharge system 26 could include one or more batteries 28 or any other power source, associated electronic circuitry 30 to control the electrical output, and one or more activation mechanisms to enable and, additionally or alternatively to activate the electrical discharge. Enablement or activation of the electrical discharge could be carried forth automatically in specified conditions or in response to specified input. Additionally or alternatively, the electrical discharge could be enabled or activated by a momentary switch 34 with electricity being discharged only when the switch 34 is depressed or otherwise triggered or for a timed output, such as by activating for a predetermined amount of time or a predetermined number of activations in response to sensed external contacts.

In the depiction of FIG. 4, the batteries 28, associated electronic circuitry 30, and switch 34 have been removed as might be necessary or desirable for recharging, repair or replacement, or cleaning of the shield cover 12. Here, the electrical discharge system 26 is readily removable from the shield cover 12. Of course, such removability could be carried forth in numerous ways within the scope of the invention. In the illustrated embodiment, the shield cover 12 has a hook or loop portion 50 centrally disposed thereon, and positive and negative electrical connectors 52 are disposed adjacent thereto. The electrical connectors 52 are in electric communication with the positive and negative electrically conductive pathways 22A and 22B such that the battery or batteries 28 and associated electronic circuitry 30 could be readily connected and disconnected from the shield cover 12. The electrical connectors 52 could, for instance, comprise button connectors, plug connectors, or any other effective type of connector.

As shown in FIGS. 4 and 7, for instance, the present embodiment of the shield cover 12 could further include one or more zippers 42 or other selective closure mechanisms to facilitate the shield cover 12 being removed, replaced, and retained relative to the shield body 14. Moreover, straps 46 can assist in selectively retaining the shield cover 12 relative to the shield body 14, and resilient webbing loops 44 can span laterally across the inner face of the shield cover 12 to permit, among other things, the selective retention of necessary articles (not shown). Still further, the illustrated embodiment of the shield cover 12 incorporates a window 40 therein corresponding in shape and location to a window in the shield body 14 relative to which the shield cover 12 is to be retained.

With certain exemplary embodiments and details of the present invention for a shield cover 12 and shield 10 incorporating the same disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. A shield cover for being removably retained relative to a shield with a shield body, the shield cover comprising:

a shield cover body for being applied to, retained by, and removed from the shield body wherein the shield cover body is at least partially formed form a stretch fabric and the shield cover body is adapted to stretch and fit over the shield;

an electrical discharge system wherein the electrical discharge system comprises a source of electrical power, at least one electrically conductive pathway retained by the shield cover body, electronic circuitry operative to control electrical output, and an actuator for activating the electrical discharge system to an activated condition wherein electrical power is applied to the electrically conductive pathway;

electrical insulation material retained by the shield cover body for preventing arcing relative to the shield body;

wherein the shield cover is adapted for being removably and replaceably retained relative to a shield with protruding mounting hardware and wherein the shield cover further comprises openings in the shield cover body corresponding in location to the protruding mounting hardware of the shield.

2. The shield cover of claim 1 wherein the at least one electrically conductive pathway is formed by conductive thread.

3. The shield cover of claim 2 wherein the at least one electrically conductive pathway has a positive conductive thread and a negative conductive thread.

4. The shield cover of claim 1 wherein the actuator for activating the electrical discharge system to an activated condition comprises a switch for selectively activating the electrical discharge system and wherein at least the source of electrical power and the electronic circuitry of the electrical discharge system are removable and replaceable in relation to the shield cover body by positive and negative electrical connectors in electric communication with the at least one electrically conductive pathway retained by the shield cover body so that the source of electrical power and the electronic circuitry can be connected and disconnected from the shield cover body.

5. The shield cover of claim 4 wherein the switch comprises a momentary switch wherein electricity is discharged by the electrical discharge system only when the switch is triggered.

6. The shield cover of claim 4 wherein the switch is retained relative to the shield cover body by a flexible cord.

7. The shield cover of claim 1 further comprising an arcing structure retained by the shield cover body wherein the arcing structure is capable of producing at least one visible electrical arc when actuated.

8. The shield cover of claim 1 further comprising an arcing structure retained by the shield cover body wherein the arcing structure is capable of producing at least one audible electrical arc when actuated.

9. The shield cover of claim 1 wherein the electrically conductive pathway comprises a positive electrically conductive pathway and a negative electrically conductive pathway and further comprising a spark gap wherein the positive electrically conductive pathway and the negative electrically conductive pathway communicate longitudinally in spaced, substantially parallel relation along the spark gap and wherein the positive electrically conductive pathway and the negative electrically conductive pathway are exposed over at least a portion of the spark gap.

10. The shield cover of claim 1 wherein the openings in the shield cover body have edges and wherein electrical insulation material retained by the shield cover body is incorporated into the edges of the openings thereby to avoid electrical arcing between the shield cover body and the shield.

11. The shield cover of claim 1 further comprising a shield with a shield body wherein the shield cover is removably retained relative to the shield.

12. A shield cover for being removably retained relative to a shield with a shield body, the shield cover comprising:

a shield cover body for being applied to, retained by, and removed from the shield body wherein the shield cover body is at least partially formed form a stretch fabric and the shield cover body is adapted to stretch and fit over the shield;

an electrical discharge system wherein the electrical discharge system comprises a source of electrical power, at least one electrically conductive pathway retained by the shield cover body, electronic circuitry operative to control electrical output, and an actuator for activating the electrical discharge system to an activated condition wherein electrical power is applied to the electrically conductive pathway;

wherein the shield cover is adapted for being removably and replaceably retained relative to a shield with a window and wherein the shield cover further comprises a window in the shield cover body corresponding in location to the window of the shield.

13. The shield cover of claim 12 further comprising a shield with a shield body wherein the shield cover is removably retained relative to the shield.

* * * * *